US005758448A

United States Patent [19]

Thummel

[11] Patent Number: 5,758,448

[45] Date of Patent: Jun. 2, 1998

[54] LASER SYSTEM MOUNTING DEVICE

[75] Inventor: Heinz F. Thummel, Salinas, Calif.

[73] Assignee: Laser Devices, Inc., Monterey, Calif.

[21] Appl. No.: 774,737

[22] Filed: Jan. 2, 1997

[51] Int. Cl.[6] ..... F41G 1/36

[52] U.S. Cl. ..... 42/103; 362/114

[58] Field of Search ..... 42/103, 101; 362/110, 362/113, 114

[56] References Cited

U.S. PATENT DOCUMENTS

| | | | |
|---|---|---|---|
| 2,236,736 | 4/1941 | Scott | 362/110 |
| 2,491,431 | 12/1949 | Unertl et al. | 33/248 |
| 4,021,954 | 5/1977 | Crawford | 42/101 |
| 4,348,716 | 9/1982 | Storm et al. | 362/110 |
| 4,383,371 | 5/1983 | Coffey | 42/101 |
| 4,814,957 | 3/1989 | Dennis | 362/110 |
| 5,323,555 | 6/1994 | Jehn | 42/103 |
| 5,581,898 | 12/1996 | Thummel | 42/103 |
| 5,621,999 | 4/1997 | Moore | 42/103 |
| 5,628,555 | 5/1997 | Sharrah et al | 362/114 |

FOREIGN PATENT DOCUMENTS

| | | | |
|---|---|---|---|
| 5029 | of 1913 | United Kingdom | 362/114 |

*Primary Examiner*—Stephen M. Johnson
*Attorney, Agent, or Firm*—Patrick T. King

[57] ABSTRACT

A mounting system attaches directly to a square or round trigger guard of a firearm. A separate trigger guard mount assembly includes a base having a groove formed therein for receiving a forward portion of a trigger guard of the firearm. A trigger guard mount clamp for attaches the trigger guard mount base to the forward portion of a trigger guard. A screw-operated clamp removably attaches a light housing assembly to the trigger guard mount assembly where the light housing contains a laser light source or a light bulb. A dovetail is formed on the trigger guard mount base to engage a dovetailed slot on the light housing, where the dovetailed slot is adjustable in width for releasably capturing the dovetail of the trigger guard mount base. The trigger guard mount assembly also includes set screws for fixing the trigger guard mount assembly in position on the forward portion of the trigger guard of the firearm. One or more shims are contained within the groove of the trigger guard mounting assembly. The shims have various thicknesses to compensate for the widths of the trigger guard of the various firearms. The trigger guard mount base and the trigger guard mount clamp are held together with a self-tapping screw.

17 Claims, 7 Drawing Sheets

LASER SYSTEM MOUNTING DEVICE

BACKGROUND OF THE INVENTION

1. Field of the Invention

This invention relates to mounts for lasers, and more particularly, to a mount for a sighting laser used to aim a firearm.

2. Prior Art

Using a laser beam to aim a firearm has gained considerable popularity in recent years with the advent of rugged low power gas lasers and solid state diode lasers. Laser aiming devices of small size are now available for attachment to various types of firearms, including handguns. In operation, when a firearm sighting laser is activated, a spot of light is formed on a target where the spot indicates the impact point of a firearm projectile. Even inexperienced firearm shooters can hit an intended target with a high degree of accuracy by simply pointing the firearm so that the laser spot is projected onto a target.

A firearm sighting laser generates a spot of light that is either visible or invisible to the unaided eye. Some type of conventional lasers provide a bright red visible beam of light which is highly visible with appropriate lighting conditions. In other types of application, such as military applications, it is preferred that the laser spot is visible to only the firearm user. For such applications, a laser is selected such that its light cannot be seen unaided. Infrared lasers are one example of lasers which are visible only with the aid of an infrared scope. Otherwise such a laser beam is invisible.

A projectile discharged from a firearm follows a generally flattened parabolic trajectory. A laser beam propagates in a straight-line trajectory.

Therefore, the straight-line trajectory of the laser beam intersects the flattened parabolic trajectory of the impact point of the projectile for only a certain range of target distances. If the range of the target is varied substantially, the laser beam is required to be realigned to accurately intersect a new impact point for the projectile. The light elements of a sighting laser are typically contained within a housing which is rigidly mounted to the firearm.

Most of the conventional apparatus used for attaching a sighting laser to a firearm suffer from number of drawbacks. Recoil subjects the sighting laser to extreme shock and vibration. Small misalignments of the sighting laser housing with respect to the firearm can result in substantial displacement of the laser spot with respect to the intended impact point. Conventional sighting laser mounts and housing can be very bulky and are subject to misalignments due to discharge of the firearm or rough handling of the firearm, particularly in military and law enforcement applications.

One conventional approach for mounting a sighting laser on a firearm is to use attachment techniques developed for optical sighting devices such as low-power optical telescopes. These techniques either obscure or make the iron sights on the firearm unusable for military or law enforcement applications.

Another conventional approach is to mount the sighting laser underneath the barrel of the firearm by attaching the sighting laser to the trigger guard of the firearm. Most of these type of mounts cannot be secured firmly enough to the trigger guard to prevent eventual rotational displacement of the sighting laser after being subject to recoil of a number of firearm discharges. The rotational displacement of the sighting laser causes misalignments of the laser spot with respect to an intended target point. Consequently, these types of prior art mounts generally require frequent realignment. These types of prior art mounts generally do not allow other types of equipment, such as for example, a tactical flashlight, to be alternatively mounted to the firearm.

One improved kind of laser mounting system which attaches to a trigger guard is disclosed in U. S. Pat. No. 5,581,898, which issued Dec. 10, 1996, for a "Modular Sighting Laser For A Firearm", invented by Heir Thumbed and assigned to the Assignee of the present Application. The mount disclosed therein includes a one-piece combination mounting block and laser housing which is fixed to the trigger guard and which has one adjustment screw engaging the front surface of the trigger guard. Obviously, this type of mount does not allow the laser to be easily removed from the firearm. Further, this type of prior art mount is specifically designed for one type of firearm and does not readily accommodate, for example, various trigger-guard widths and shape, that is square or round, for various types of firearms.

Consequently, a need exists for a compact and rugged removable sighting laser mount for a firearm which can be rigidly attached to a firearm, while allowing for rapid installation and removal of the laser or other illumination device.

SUMMARY OF THE INVENTION

It is therefore an object of the invention to provide a compact and rugged removable sighting laser mount for a firearm which allows for rapid installation and removal of the laser or other illumination device, such as a tactical flashlight.

In accordance with these and other objects of the invention, a mounting system for attachment to a trigger guard of a firearm includes a separate trigger guard mount assembly. The trigger guard mount assembly includes a base having a groove formed therein for receiving a forward portion of a trigger guard of a firearm. The trigger guard mount assembly also includes a trigger guard mount clamp for attaching the trigger guard mount base to the forward portion of a trigger guard of a firearm to form the trigger guard mount assembly. A separate light housing clamp is provided for removably attaching a light housing assembly to the trigger guard mount assembly. The light housing assembly contains a light element such as a visible or invisible laser light source or a light bulb.

The trigger guard mount assembly includes a tongue which engages a corresponding adjustable-width slot in the light housing assembly. In one preferred embodiment of the invention the tongue is a dovetail which is formed on the trigger guard mount base. The corresponding slot is a dovetailed slot which is adjustable in width for receiving and capturing the dovetail of the trigger guard mount base.

The trigger guard mount assembly also includes set screws for fixing the trigger guard mount assembly in position on the forward portion of the trigger guard of the firearm. One or more shims are contained within the groove of the trigger guard mounting assembly. The shims have various thicknesses to compensate for the widths of the trigger guard of the various firearms.

The trigger guard mount base and the trigger guard mount clamp are held together with a self-tapping screw.

Another aspect of the invention includes a laser mounting system for a sighting laser which is removably attached to a trigger guard of a firearm. The laser mounting system includes a separate, fixed trigger guard mount assembly which is fixed to the forward part of a trigger guard of a firearm and which includes a dovetail mount. A separate, detachable laser housing assembly includes a dovetailed slot which has laterally-adjustable width and which engages the dovetail mount on the trigger guard mount assembly to provide for removable attachment of the laser housing assembly to the dovetail on the trigger guard mount assembly. The separate trigger guard mount assembly includes a trigger guard mount base which has a slot formed therein for receiving the forward portion of the trigger guard. The separate trigger guard mount assembly also includes a trigger guard clamp piece which is adjustable fixed to the trigger guard mount base and which also has a slot formed therein for receiving the portion of the trigger guard.

The trigger guard mounting base and the trigger guard clamp piece are fixed together with projecting pins which engage corresponding holes and at least one self-tapping screw engaging a corresponding hole. The trigger guard mount base has a pair of threaded bores formed therein for receiving respective set screws which engage the trigger guard and fixes the trigger guard mount assembly in position with respect to the trigger guard.

The trigger guard mount assembly has another threaded bore formed therein for receiving another set screw which also engages a round trigger guard and fixes the trigger guard mount assembly in position with respect to the round trigger guard.

The laser housing assembly includes a spring-loaded adjustable clamp piece for adjustment of the width of the dovetailed slot and engagement with the dovetail mount on the trigger guard mount assembly. The position of the spring-loaded adjustable clamp piece is adjusted with a set screw or a thumbscrew.

At least one pair of shims are provided for adjusting the width of the slots formed in the trigger guard mount assembly and in the trigger guard clamp piece to conform to the various widths of trigger guards for various firearms.

A resilient clamp member is provided for mounting a flashlight to the laser housing assembly. The clamp has its two proximate ends engaging slots formed in the sides of the laser housing assembly. The clamp has a distal loop portion for engagement with a flashlight. The clamp also has a mid portion which is laterally adjustable with a screw and nut for resiliently clamping the loop portion around the flashlight and for resiliently clamping the ends of the clamp member in the slots formed in the sides of the laser housing assembly.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
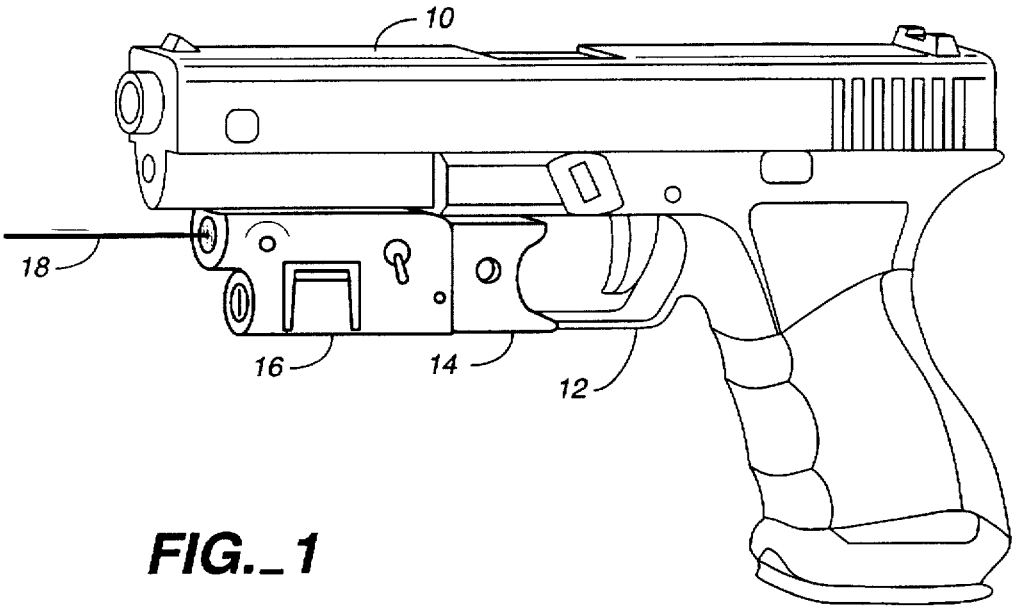
FIG. 1 is an isometric view showing a laser housing releasably attached to a trigger-guard mount for a handgun, according to the invention.

FIG. 1 shows a handgun 10 with a trigger guard 12. A trigger guard mount assembly 14 is rigidly and releasably attached to the front portion of the trigger guard 12 beneath the barrel assembly of the handgun 10 using an Allen-head screw or a quick-release thumbscrew (not shown in this Figure). The trigger guard mount assembly 14 provides a rigid mounting for a laser housing assembly 16 which projects a beam 18 of coherent visible or invisible light to a target point in front of the handgun 10.

Figure 2:
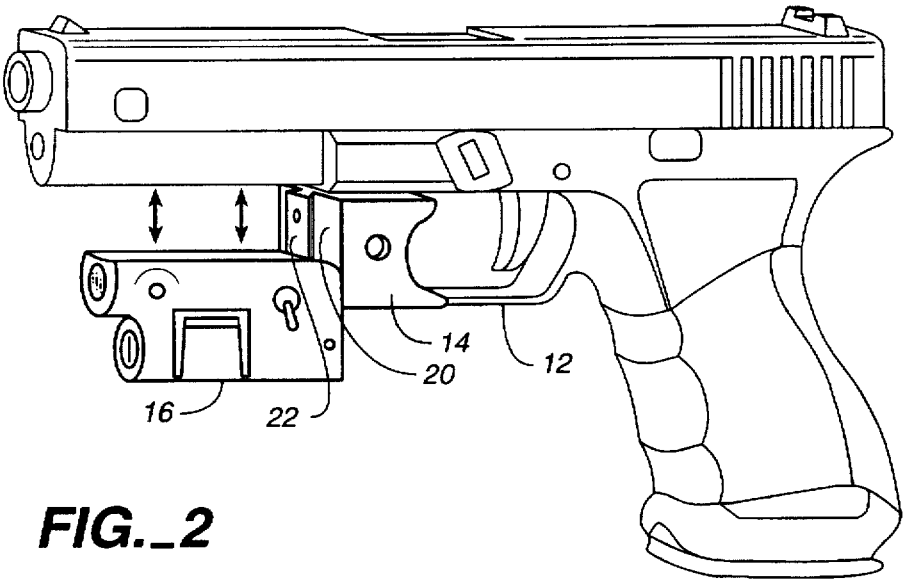
FIG. 2 is an isometric view, similar to FIG. 1, in which the laser housing is shown being removed from the trigger-guard mount.

FIG. 2 shows the laser housing assembly 16 being removed from the trigger-guard mount assembly 14. A forward face 20 of the trigger-guard mount assembly 14 has a vertical dovetail mount, or tongue, 22 formed therein. A corresponding dovetailed slot is formed on the rear face of the laser housing assembly 16 so that the dovetailed slot slides into engagement with the dovetail 22. The dovetail 22 is captured in the dovetailed slot by tightening the Allen-head screw or the thumbscrew, as described herein below. Similarly, to remove the laser housing assembly 16, the dovetail 22 is released from the dovetailed slot by loosening the Allen-head screw or the quick-release thumbscrew. For durability and rugged construction, glass filled polycarbonate material is used for the components of the laser housing assembly 16 and for the trigger guard mount assembly 14.

Figure 3:
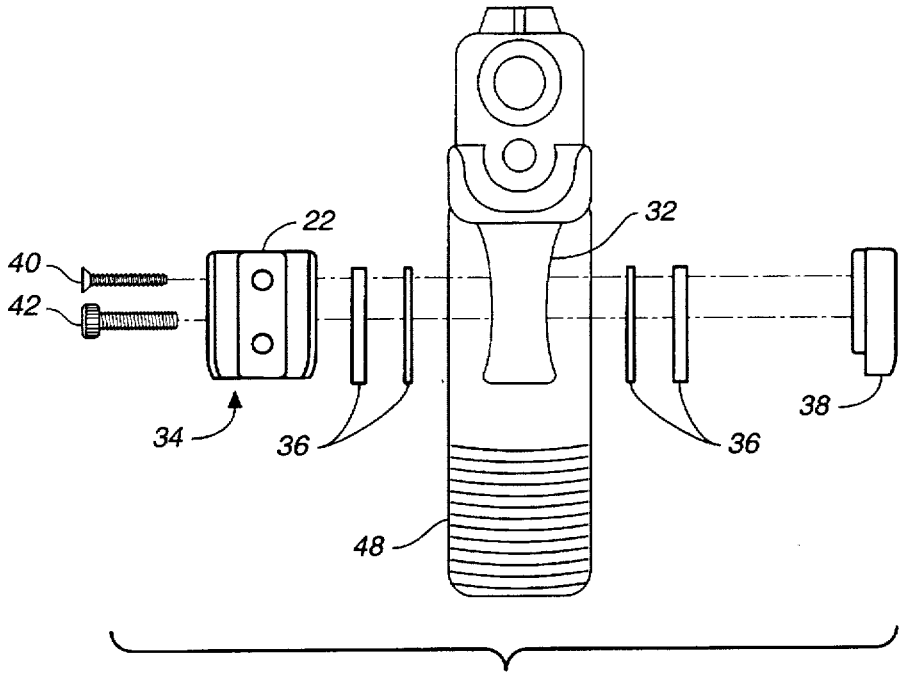
FIG. 3 is a front, exploded view of a trigger-guard mount assembly for a square trigger guard.
Figure 4:
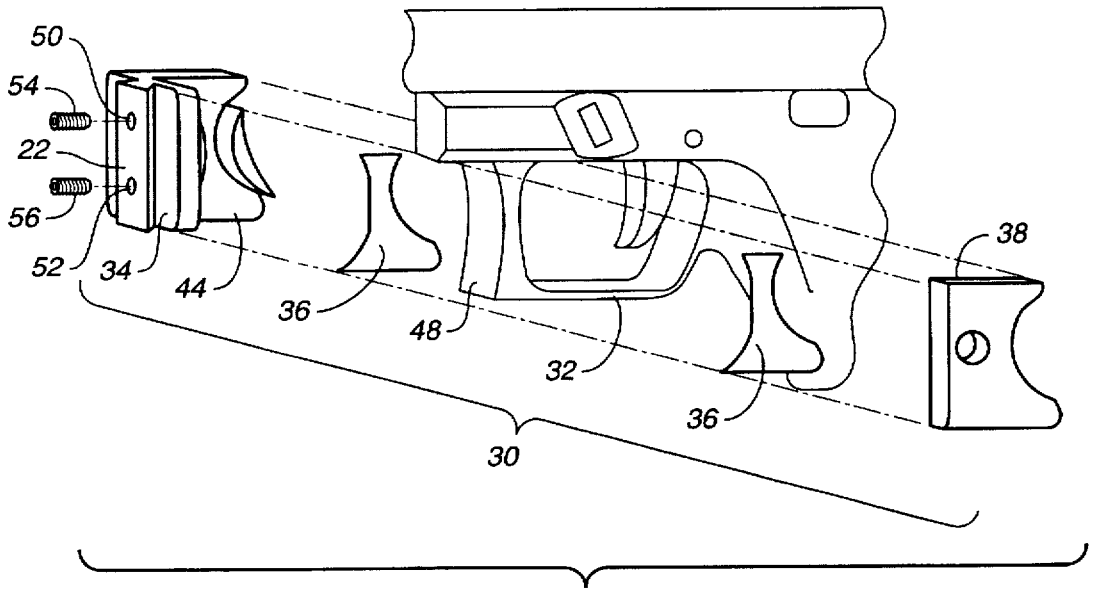
FIG. 4 is an exploded, isometric view, similar to FIG. 3, of a trigger guard mount assembly for a square trigger guard.

FIGS. 3 and 4 show in an exploded format the components for assembling a trigger-guard mount assembly 30 to the front portion of a square trigger guard 32. These components include a trigger guard mount base 34, two pairs of shims 36 (as needed), a trigger guard mount clamp piece 38, a self tapping screw 40, and an Allen-head screw 42.

Figure 7A:
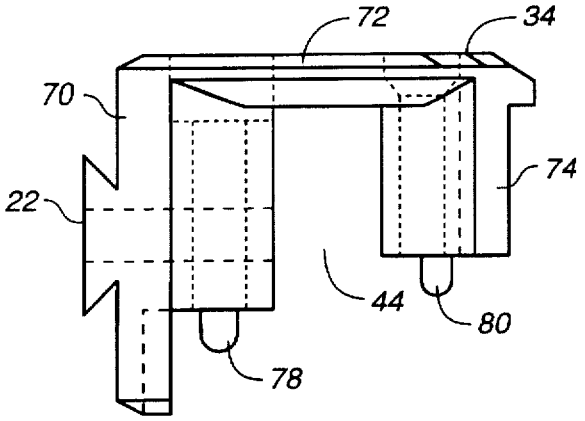
FIG. 7A is a front view of a trigger-guard mount base.
Figure 7B:
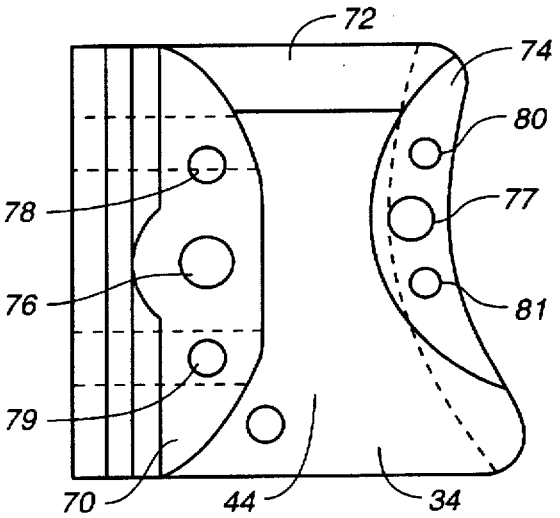
FIG. 7B is a side view of a trigger-guard mount base.
Figure 7C:
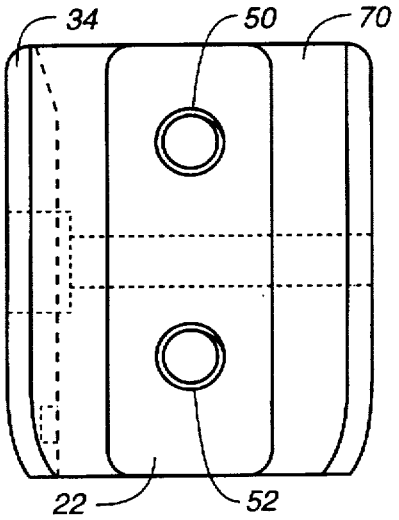
FIG. 7C is a top view of a trigger-guard mount base.
Figure 8A:
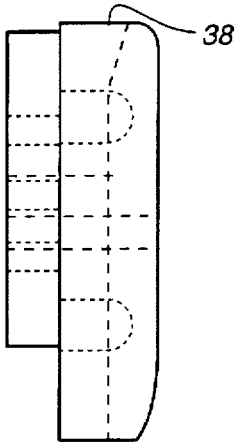
FIG. 8A is a front view of a trigger-guard mount clamp for a square trigger guard.
Figure 8B:
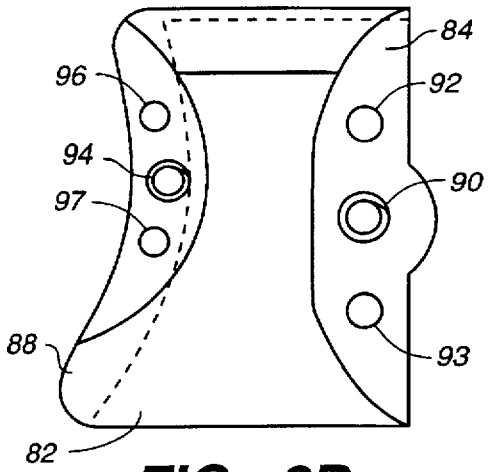
FIG. 8B is a side view of a trigger-guard mount clamp for a square trigger guard.
Figure 8C:
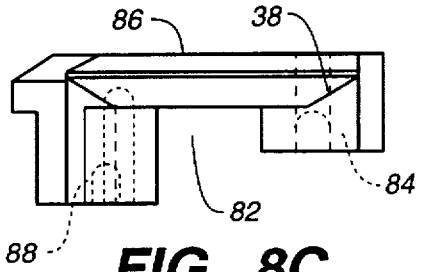
FIG. 8C is a top view of a trigger-guard mount clamp for a square trigger guard.

The trigger guard mount base 34, as shown and described herein below in connection with FIGS. 7A–C, is a roughly U-shaped piece which has a thick front wall from which the dovetail 22 extends, a thinner flat side wall, and a curved rear wall which engages the rear side of the front portion of the trigger guard 14. The trigger guard mount base 34 includes a slot 44 formed therein for accommodating part of the forward portion 48 of the trigger guard 32. The trigger guard clamp piece 38, as shown and described herein below in connection with FIGS. 8A–C, is a shorter roughly U-shaped piece which also has a corresponding slot formed therein for receiving the other part of the front portion of the trigger guard. The shims 36 are contained in the slots for adjusting the width of the slot provided in the trigger guard mount assembly 34 and in the trigger guard clamp piece 38 to conform to the various widths of trigger guards for various firearms and to center the trigger guard mount assembly 30 on the trigger guard.

The trigger guard mount base 34 and the trigger guard mount clamp 38 with the shims 36 in the slots therein are assembled with the self taping screw 40 engaging a corresponding bore formed in the trigger guard mount clamp 38. It has been found that the self-tapping screw arrangement provides a stronger connection between the trigger guard mount base 34 and the trigger guard mount clamp 38 by biting into the material of the trigger guard mount clamp 38. The Allen-head screw 42 engages a threaded hole in the trigger guard mount clamp 38.

The trigger guard mount base 34 has a pair of vertically-spaced threaded bores 50, 52 formed therein for receiving respective set screws 54, 56. The ends of the set screws 54, 56 engage the outside surface of the forward portion 48 of the trigger guard 32. Each of the set screws is adjusted to rigidly fix the trigger guard mount assembly in position with respect to the trigger guard and to position the trigger guard mount base 34 at a ninety degree angle with respect to the axis of the barrel of the firearm.

Figure 5:
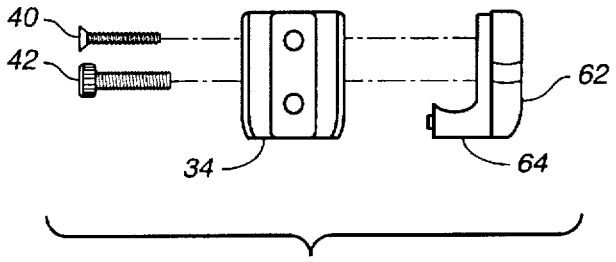
FIG. 5 is an exploded, front view of a trigger-guard mount assembly for a round trigger guard.
Figure 6:
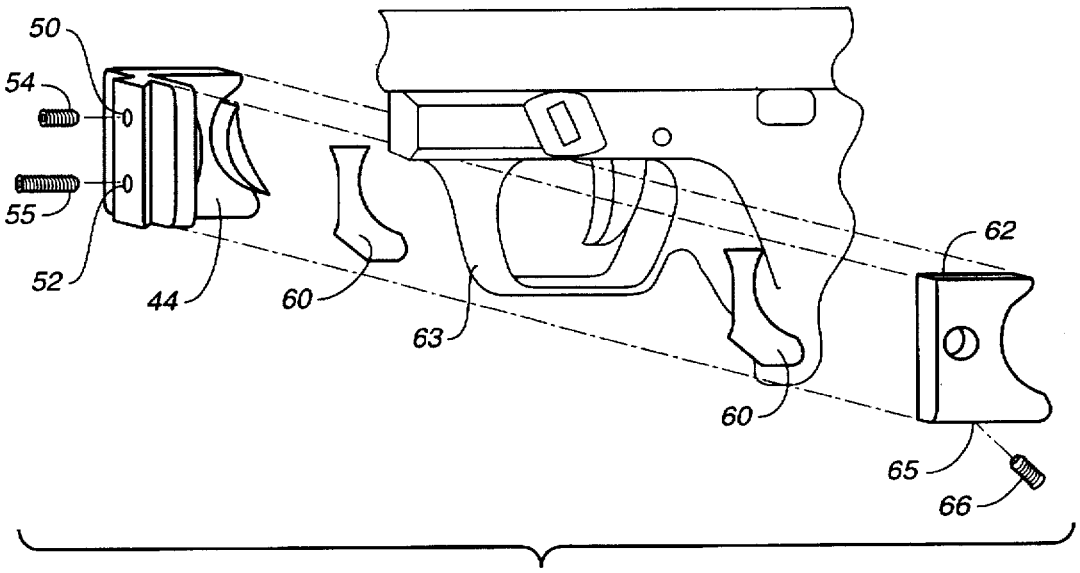
FIG. 6 is an exploded, isometric view, similar to FIG. 5, of a trigger guard mount assembly for a round trigger guard.

FIGS. 5 and 6 show the components for assembling a trigger-guard mount assembly 30 to the front portion of a round trigger guard 63. These components include a trigger guard mount base 34, modified shims 60, a modified round trigger guard mount clamp 62, a self-tapping screw 42, and an Allen-head screw 40. The trigger guard mount base 34 and the modified round trigger guard mount clamp 62 along with the modified shims 60 in the slots therein are assembled with the self tapping screw 40 engaging a bore formed in the trigger guard mount clamp 60 and with the Allen-head screw 42 engaging a threaded hole in the trigger guard mount clamp 38.

The arrangement of FIGS. 5 and 6 for a round trigger guard 63 are similar to the arrangement of FIGS. 3 and 4 for a square trigger guard. The trigger guard mount base 34 has a pair of vertically-spaced threaded bores 50, 52 formed therein for receiving a respective set screw 54 and a longer set screw 55. The ends of the set screws 54, 55 engage the forward portion 48 of the trigger guard 32 and are adjusted to firmly fix the trigger guard mount assembly in position with respect to the trigger guard and also to allow adjustment of the trigger guard mount assembly with respect to the barrel of the firearm.

The modified trigger guard mount clamp 62 includes an additional portion 64 which projects into the trigger guard mount base 34 and which includes a threaded hole 65 formed therein for receiving a set screw 66, the end of which engages the rounded trigger guard 62. The set screws 54, 55, and 66 are all adjusted to rigidly fix the trigger guard mount assembly in position with respect to the rounded trigger guard 62 and with respect to the axis of the barrel of the firearm.

FIGS. 7A–C show respective front, side, and top views of a universal trigger-guard mount base 34, showing the slot 44 and the dovetail 22. The universal trigger-guard mount base 34 is used for both square and for round trigger guards. The universal trigger guard mount base 34 is a roughly Ushered piece which has a thick front wall 70 from which the dovetail 22 extends, a thinner flat side wall 72, and a curved rear wall 74. The front surface of the curved rear wall 74 engages the rear side of the front portion of the trigger guard 14. The trigger guard mount base 34 includes a slot 44 formed therein for accommodating part of the forward portion 48 of the trigger guard 32.

The front wall 70 of the trigger-guard mount base 34 has the threaded bores 50, 52 formed therethrough. The front wall 70 also has a laterally extending, horizontal bore 76 formed therein through which extends the Allen-head screw 42. The front wall 70 also has two laterally extending, horizontal pins 78, 79 extending therefrom.

The curved rear wall 74 of the trigger-guard mount base 34 has a laterally extending, horizontal bore 77 formed therein and through which extends the self-tapping screw 40. The curved rear wall 74 also has two laterally extending, horizontal pins 80, 81 extending therefrom.

FIGS. 8A-C show respective front, side, and top views of a square trigger-guard mount clamp 38 for a square trigger guard. The square trigger guard mount clamp 38 contains a slot 82 for receiving a portion of a square trigger guard. The round trigger guard clamp piece 38 is a shorter roughly U-shaped piece which has a thick front wall 84 , a thinner flat side wall 86, and a curved rear wall 88. One shim from each pair of shims 36 are contained in the slot 82 (as needed) for adjusting the width of the slot to conform to the various widths of square trigger guards for various firearms and also to center the trigger guard mount assembly on the square trigger guard.

The thick front wall 84 of the square trigger-guard mount clamp 38 has a side surface which engages a corresponding surface of the mounting base 34. A threaded hole 90 is formed in the thick front wall 84 to receive the Allen head screw 42. Respective holes 92, 93 are formed in the thick front wall 84 to receive the laterally extending, horizontal pins 78, 79 extending from the mounting base 34.

The curved rear wall 88 of the square trigger-guard mount clamp 38 has a side surface which engages a corresponding surface of the mounting base 34. The curved rear wall 88 of the square trigger-guard mount clamp 38 has a hole 94 formed therein for receiving the self-tapping screw 40. Respective holes 96, 97 are formed in the curved rear wall 88 to receive the laterally extending, horizontal pins 80, 81 extending from the mounting base 34.

The self tapping screw 40, the Allen-head screw 42, and the pins 78, 79, 80, 81 from the mounting base 34 engaging the corresponding holes on the mount clamp 38 provide strong, secure connections between the mounting base 34 and the mount clamp 38 such that the trigger-guard mount assembly 14 is rigidly attached to the trigger guard.

Figure 9A:
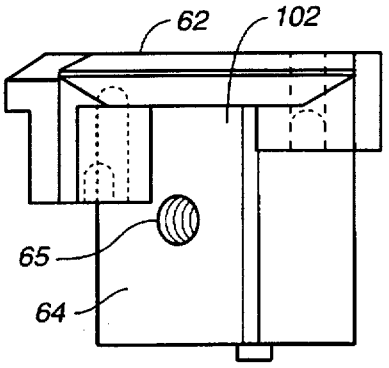
FIG. 9A is a top view of a trigger-guard mount clamp for a round trigger guard.
Figure 9C:
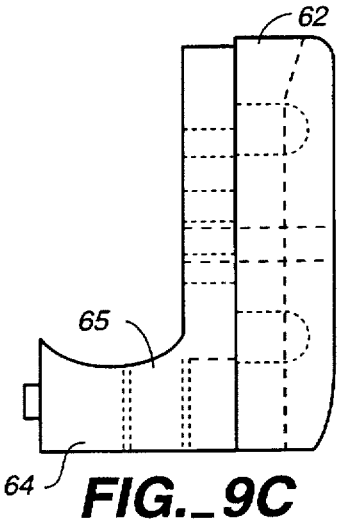
FIG. 9C is a front view of a trigger-guard mount clamp for a round trigger guard.
Figure 9B:
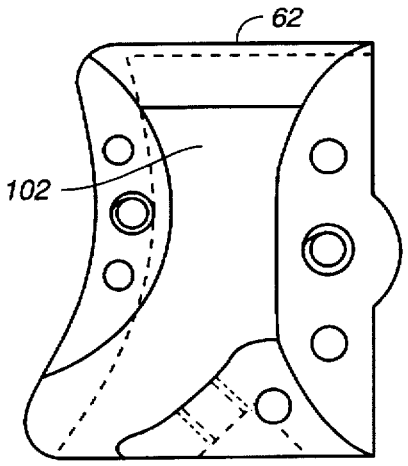
FIG. 9B is a side view of a trigger-guard mount clamp for a round trigger guard.

FIGS. 9A–C show respective front, side and top views of a round trigger guard mount clamp 62 for a round trigger guard 63, showing a slot 102 for receiving a portion of the round trigger guard. The round trigger-guard clamp piece 62 has a number of the same features of the square trigger guard mount clamp 38 described herein above.

The modified round trigger guard mount clamp 62 also includes an additional portion 64 which projects into the trigger guard mount base 34 and which includes a threaded hole 65 formed at an angle therein for receiving a set screw 66, the end of which engages the rounded trigger guard 62. This allows the set screws 54, 55, and 66 all to be adjusted to rigidly fix the trigger guard mount assembly in position with respect to the rounded trigger guard 62 and with respect to the axis of the barrel of the firearm.

Figure 10:
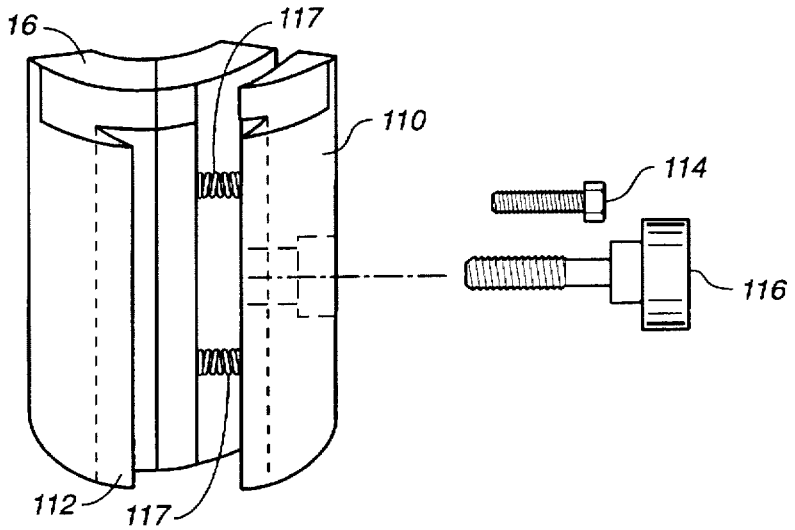
FIG. 10 is an exploded rear view of a laser housing assembly and a clamp piece which define a slot in the laser housing assembly.

FIG. 10 is an exploded rear view of a laser housing assembly 16 and a clamp piece 110 which define a slot 112 which is adjustable in width for receiving and clamping the dovetail 22 of the trigger-guard mount base 34 using an Allen-head screw 114 or an optional quick-release thumbscrew 116. The slot 112 is held open using two springs 117 with their ends captured in holes formed in the laser housing assembly 34 and the clamp piece 110. The springs 117 are compressed to open the slot 112 when the Allen-head screw 114 or the quick-release thumbscrew 116 is released.

Figure 11A:
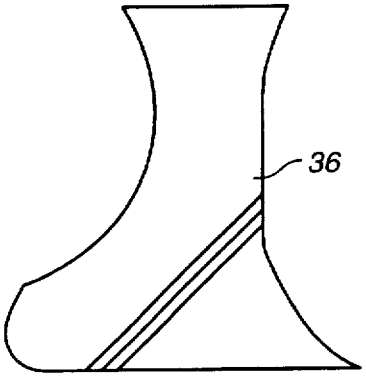
FIG. 11A is a plan view of a shim for a trigger-guard mount assembly used with a square trigger guard.

FIG. 11A shows a plan view of a shim 36 for a trigger-guard mount assembly used with a square trigger guard. One or more pairs of shims 36 are provided in various thicknesses to compensate for the widths of the square trigger guards of the various firearms.

Figure 11B:
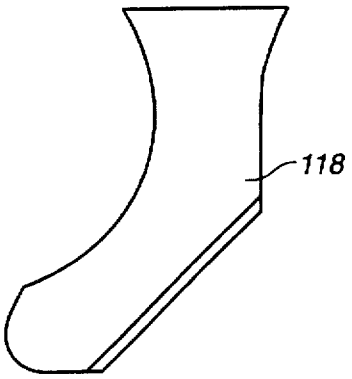
FIG. 11B is a plan view of a shim for a trigger-guard mount assembly used with a round trigger guard.

FIG. 11B is a plan view of a shim 118 for a round trigger guard which has its sharp lower corner removed. One or more pairs of shims 118 are also provided in various thicknesses to compensate for the widths of the round trigger guards of the various firearms. Note that the shim 118 is provided by breaking off the lower corner of the shim 36 along a scored line. This allow the shims 118 to accommodate the additional portion of the round trigger guard mount clamp 62 which projects beneath the round trigger guard to hold the set screw 66, as shown in FIG. 6.

The shims 36 and 118 are provided in pairs such that each shim is a mirror image of its mate. Six pairs of shims of different thicknesses are provided so that various pairs of shims can be combined as needed to compensate for the different widths of various trigger guards. The surface of each shim of a pair is marked with a number from 1 to 6. To find the proper combination of shims for a particular handgun, a chart is provided which lists a particular handgun and the number(s) of one or more pairs of shims to be used with that particular handgun.

Figure 12:
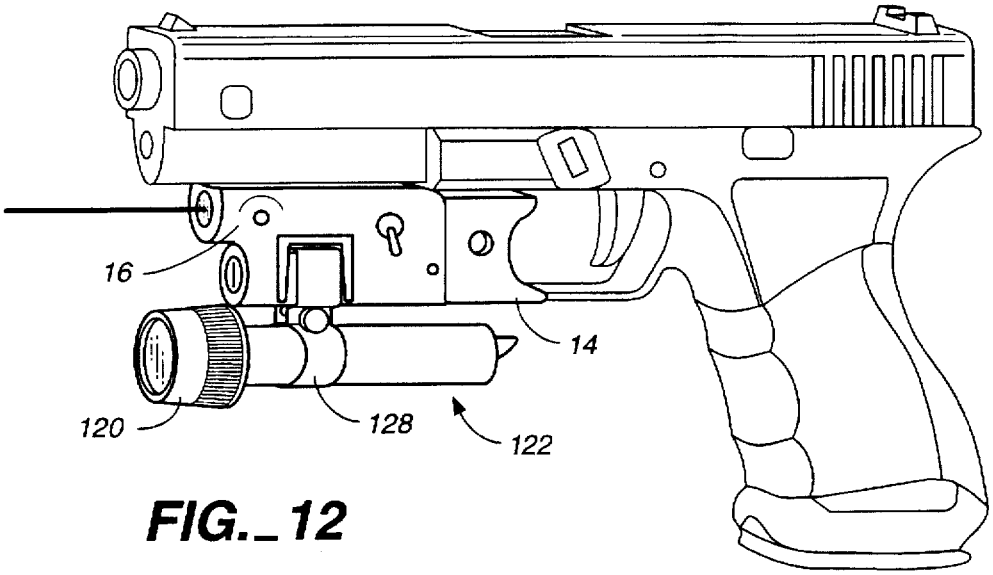
FIG. 12 is an isometric view showing a flashlight attached to a laser housing which is fixed to a trigger-guard mount.

FIG. 12 is an isometric view showing a tactical flashlight 120 attached to a laser housing 16, which is fixed to a trigger-guard mount 14. The tactical flashlight 90 is mounted to the laser housing using a bracket assembly 122.

Figure 13:
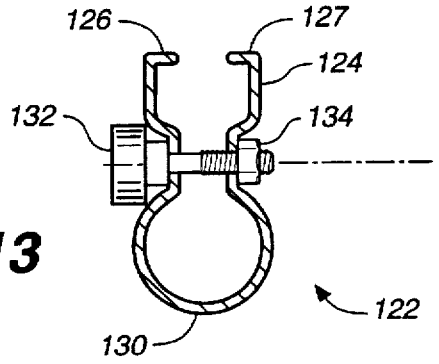
FIG. 13 is a plan view of a bracket assembly for mounting a tactical light to a laser housing.

FIG. 13 shows the bracket assembly 122 which includes a formed resilient metal strip 124 with its two proximate ends 126, 127 bent inwardly for engaging slots 128 formed on the opposite sides of the laser housing assembly 16. A distal loop portion 130 of the formed strip 124 wraps around the body of the flashlight 120. The mid portion of the formed strip 124 is laterally clamped with a thumbscrew 132 and nut 134 for resiliently clamping the loop portion 130 around the flashlight 120 and for resiliently clamping the ends 126, 127 of the clamp member in the slots 128 formed on the sides of the laser housing assembly 16.

Figure 14:
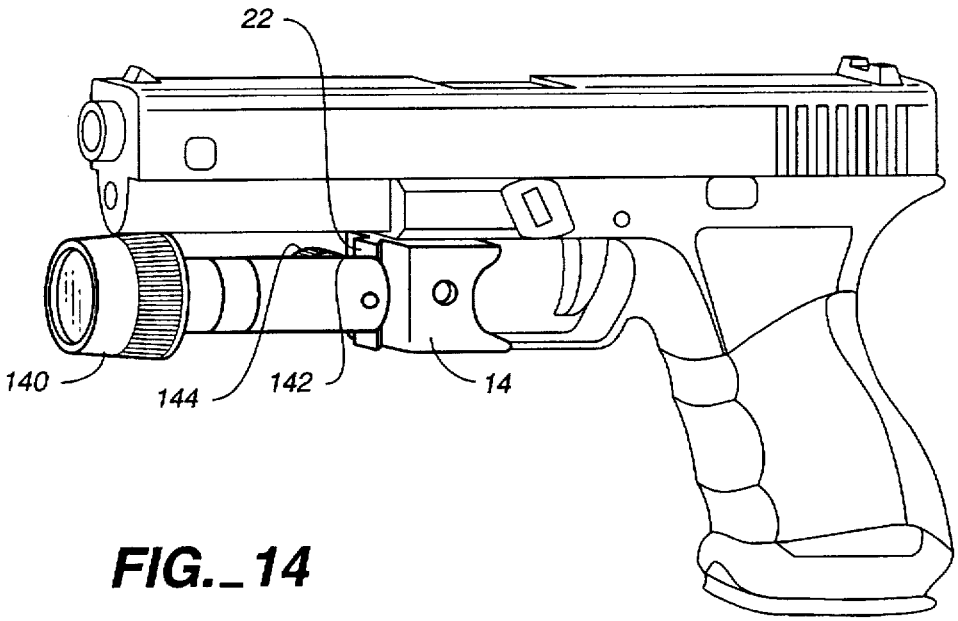
FIG. 14 is an isometric view of a tactical light which mounts directly to a trigger-guard mount.

FIG. 14 shows a tactical light 140 which has a slot 142, similar to the dovetailed slot 112 of FIG. 10, formed on its end for engagement with the dovetail 22 formed on the front face of the trigger guard mount assembly 14. A thumbscrew 144 adjusts the width of the slot 142 to clamp the light 140 to the trigger guard mount assembly 14.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

In the claim:

1. A mounting system for attachment to a trigger guard of a firearm, comprising:

a trigger guard mount base having a groove for receiving a forward portion of said trigger guard of said firearm;

a trigger guard mount clamp for attaching the trigger guard mount base to the forward portion of said trigger guard of said firearm to form a separate trigger guard mount assembly;

a light housing containing a light emitting element;

wherein the trigger guard mount includes a tongue which engages a slot for removably attaching the light housing to the trigger guard mount having an adjustable width on the light housing; and wherein the tongue of the trigger guard mount assembly includes a dovetail which is formed on the trigger guard mount base and wherein the slot having an adjustable width on the light housing is formed as a dovetailed slot for receiving and capturing the dovetail of the trigger guard mount base.

2. The mounting system of claim 1 wherein the trigger guard mount assembly includes set screws for fixing the trigger guard mount assembly in position on the forward portion of the trigger guard of the firearm.

3. The mounting system of claim 1 including a shim which is contained within said groove of the trigger guard mounting assembly and which has a thickness to compensate for the widths of the trigger guard of the various firearms.

4. The mounting system of claim 1 wherein the trigger guard mount base and the trigger guard mount clamp are held together with a self-tapping screw.

5. The mounting system of claim 1 wherein the light element includes a laser light source.

6. The mounting system of claim 5 wherein the laser light source provides visible light.

7. The mounting system of claim 5 wherein the laser light source provides invisible light.

8. The mounting system of claim 1 wherein the light element includes a light bulb.

9. A laser mounting system for a sighting laser which is removably attached to a trigger guard of a firearm, comprising:

a separate, fixed trigger guard mount assembly which is fixed to the forward part of said trigger guard of said firearm and which includes a dovetail mount;

a separate, detachable laser housing assembly which includes a dovetailed slot which has laterally-adjustable width and which engages the dovetail mount on the trigger guard mount assembly to provide for removable attachment of the laser housing assembly to the dovetail on the trigger guard mount assembly and;

wherein the separate detachable laser housing assembly includes a spring-loaded adjustable clamp piece for adjustment of the width of the dovetailed slot and engagement with the dovetail mount on the trigger guard mount assembly.

10. The mounting system of claim 9 wherein the separate trigger guard mount assembly includes a trigger guard mount base which has a slot formed therein for receiving the forward portion of the trigger guard and wherein the separate trigger guard mount assembly includes a trigger guard clamp piece which is adjustable fixed to the trigger guard mount base and which also has a slot formed therein for receiving the portion of the trigger guard.

11. The mounting system of claim 10 wherein the trigger guard mounting base and the trigger guard clamp piece are fixed together with projecting pins which project from the trigger guard mount base and which engage corresponding holes in the trigger guard clamp piece and at least one self-tapping screw which engages a corresponding hole in the trigger guard clamp piece.

12. The mounting system of claim 10 including at least one pair of shims which fit in the respective slots in the trigger guard mount base and the trigger guard clamp piece for adjusting the separate distance between the slots formed in the trigger guard mount assembly and in the trigger guard clamp piece to conform to the various widths of trigger guards for various firearms.

13. The mounting system of claim 9 wherein the trigger guard mount base has a pair of threaded bores formed therein for receiving respective set screws which engage the trigger guard and fixes the trigger guard mount assembly in position with respect to the trigger guard.

14. The mounting system of claim 13 wherein the trigger guard mount assembly has another threaded bore formed therein for receiving another set screw which also engages a round trigger guard and fixes the trigger guard mount assembly in position with respect to the round trigger guard.

15. The mounting system of claim 9 wherein the position of the spring-loaded adjustable clamp piece is adjusted with a set screw.

16. The mounting system of claim 9 wherein the position of the spring-loaded adjustable clamp piece is adjusted with a thumbscrew.

17. The mounting system of claim 9 including a resilient clamp member, which has its two proximate ends engaging slots formed in opposite sides of the laser housing assembly, which has a distal loop portion for engagement with a flashlight, and which has a mid portion which is laterally adjustable using a screw and nut for resiliently clamping the loop portion around the flashlight and for resiliently clamping the ends of the clamp member in the slots formed in the sides of the laser housing assembly.

* * * * *